US007707948B2

(12) United States Patent
Lin

(10) Patent No.: US 7,707,948 B2
(45) Date of Patent: May 4, 2010

(54) FOLDABLE TABLE

(75) Inventor: Wen-Sheng Lin, Kaohsiung (TW)

(73) Assignee: Maxchief Investments, Ltd. (CN)

( * ) Notice: Subject to any disclaimer, the term of this patent is extended or adjusted under 35 U.S.C. 154(b) by 15 days.

(21) Appl. No.: 11/779,422

(22) Filed: Jul. 18, 2007

(65) Prior Publication Data

US 2007/0272128 A1 Nov. 29, 2007

Related U.S. Application Data

(63) Continuation-in-part of application No. 11/383,776, filed on May 17, 2006, now abandoned, which is a continuation-in-part of application No. 10/763,155, filed on Jan. 21, 2004, now abandoned.

(51) Int. Cl.
*A47B 3/00* (2006.01)
*A47B 3/083* (2006.01)

(52) U.S. Cl. ..... 108/169; 108/115; 108/132

(58) Field of Classification Search ..... 108/115–135, 108/162–179
See application file for complete search history.

(56) References Cited

U.S. PATENT DOCUMENTS 1,426,962 A * 8/1922 Corpstein ..... 108/35
2,643,926 A 6/1953 Pucci
2,707,664 A * 5/1955 Marsilius ..... 108/127
3,368,504 A 2/1968 Cohen
5,357,872 A 10/1994 Wilmore
6,058,853 A 5/2000 Pinch
6,520,094 B2 2/2003 Wen
6,659,021 B2 * 12/2003 Wen ..... 108/125
6,823,806 B1 11/2004 Buono
7,418,907 B2 * 9/2008 Haimoff ..... 108/91
2002/0092445 A1 7/2002 Glover et al.

* cited by examiner

*Primary Examiner*—Janet M Wilkens
*Assistant Examiner*—Timothy M Ayres
(74) *Attorney, Agent, or Firm*—Luedeka, Neely & Graham, P.C.

(57) ABSTRACT

A collapsible table has a blow-molded tabletop comprising two table top halves. Each tabletop half has a substantially planar top surface, a bottom surface opposite the top surface, an inner edge, and an opposing outer edge which is substantially parallel to the inner edge. A hinge assembly pivotally connects the two tabletop halves along their inner edges, allowing the two tabletop halves to be folded together into a storage position. Four collapsible legs are attached to the bottom surface of the tabletop halves. Each collapsible leg is operable to collapse independently of any of the other legs. A first pair of the legs collapse to positions which are substantially parallel to the outer edges of the tabletop halves, and a second pair of the legs collapse to positions which are substantially diagonal to the outer edges of the tabletop halves.

15 Claims, 13 Drawing Sheets

FOLDABLE TABLE

This application claims priority as a continuation-in-part of co-pending U.S. patent application Ser. No. 11/383,776 filed on May 17, 2006, which is a continuation-in-part of application Ser. No. 10/763,155 filed Jan. 21, 2004, now abandoned.

FIELD

The present invention relates to a foldable table, and more particularly to a foldable table that is folded when not in use, thereby saving space of storage, package and transportation.

BACKGROUND AND SUMMARY

A conventional table is available for providing a support effect, thereby facilitating the user using the table. However, the conventional table has a fixed structure and cannot be folded when not in use, thereby increasing space of storage, and thereby causing inconvenience in storage, package and transportation.

The primary objective of the present invention is to provide a foldable table that is supported rigidly and stably when being expanded and is folded when not in use, thereby enhancing the versatility of foldable table.

Another objective of the present invention is to provide a foldable table, wherein the handle is pivoted outward to protrude from the two table boards, thereby facilitating the user carrying the foldable table.

A further objective of the present invention is to provide a foldable table that is folded when not in use, thereby saving space of storage, package and transportation.

In accordance with the present invention, there is provided a foldable table, comprising two table boards pivotally connected with each other, and two support units each foldably mounted on a respective one of the two table boards, wherein:

each of the two table boards has a bottom formed with a receiving space; and each of the support units is mounted in the receiving space of a respective one of the two table boards and includes a support stand having an end pivotally mounted on a first end of the respective table board, and a support member pivotally mounted on a second end of the respective table board and pivotally connected with the support stand.

A preferred embodiment of the invention provides a collapsible table having a substantially square tabletop. The tabletop includes two tabletop halves. Each tabletop half has a substantially planar top surface, a bottom surface opposite the top surface, an inner edge, and an opposing outer edge which is substantially parallel to the inner edge. A hinge assembly pivotally connects the two tabletop halves along their inner edges to enable the two tabletop halves to be folded together into a storage position. Attached to the bottom surface of the tabletop are legs that are collapsible to a position adjacent to the bottom surface of the tabletop.

In another embodiment, the invention provides a collapsible table having two tabletop halves, each half having a substantially planar top surface, a bottom surface opposite the top surface, an inner edge, and an opposing outer edge which is substantially parallel to the inner edge. A hinge assembly pivotally connects the two tabletop halves along their inner edges so that the two tabletop halves can be folded together into a storage position. Attached to the bottom surface of the tabletop are four collapsible legs that are each operable to collapse independently of any of the other legs.

In yet another embodiment, the invention provides a collapsible table having two tabletop halves, each half having a substantially planar top surface, a bottom surface opposite the top surface, an inner edge, and an opposing outer edge which is substantially parallel to the inner edge. A hinge assembly pivotally connects the two tabletop halves along their inner edges so that the two tabletop halves can be folded together into a storage position. Attached to the bottom surface of the tabletop are four collapsible legs. A first pair of the legs are operable to collapse to positions which are substantially parallel to the outer edges of the tabletop halves. A second pair of the legs are operable to collapse to positions which are substantially diagonal to the outer edges of the tabletop halves.

Further benefits and advantages of the present invention will become apparent after a careful reading of the detailed description with appropriate reference to the accompanying drawings.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
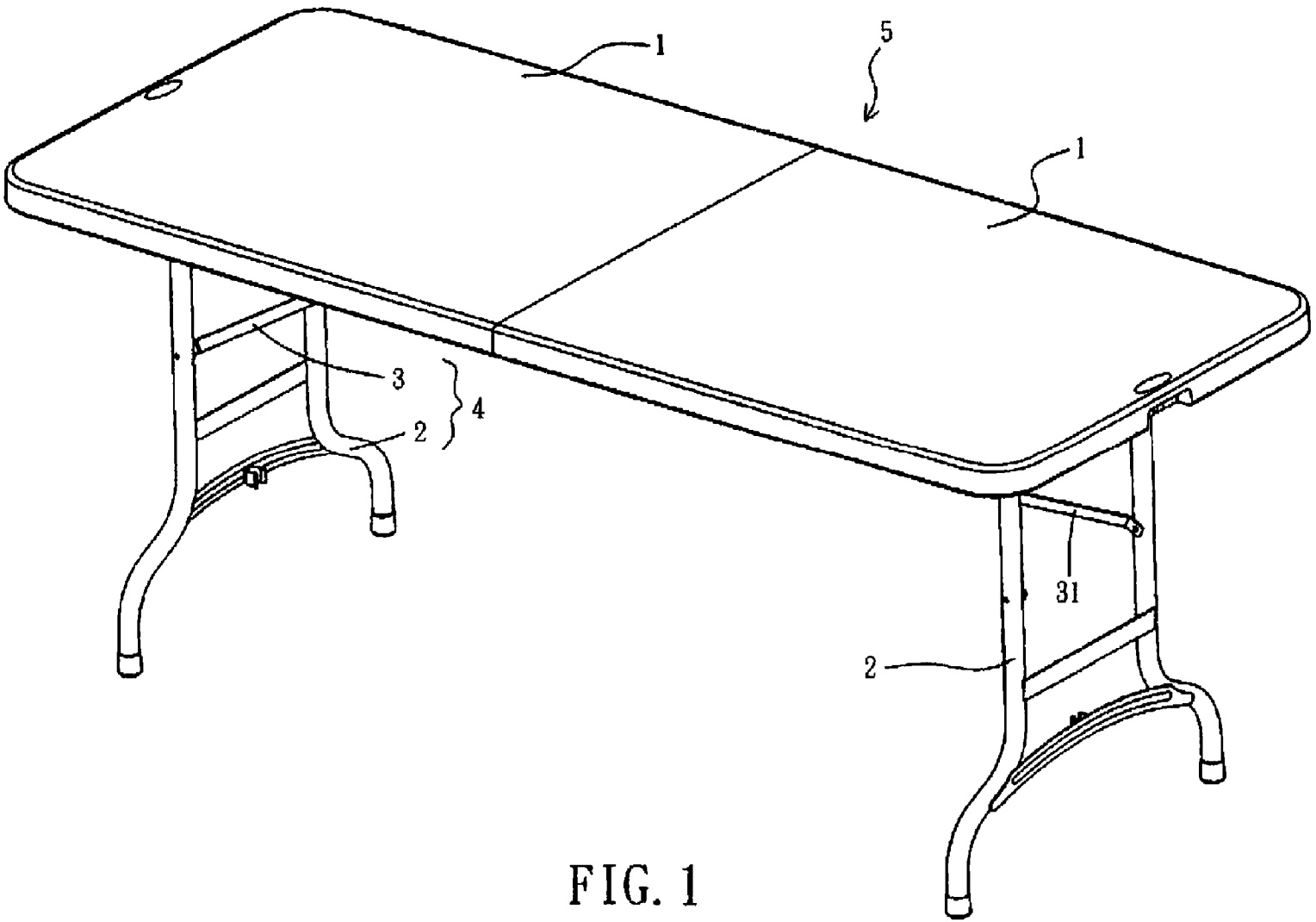
FIG. 1 is a perspective view of a foldable table in accordance with the preferred embodiment of the present invention.
Figure 2:
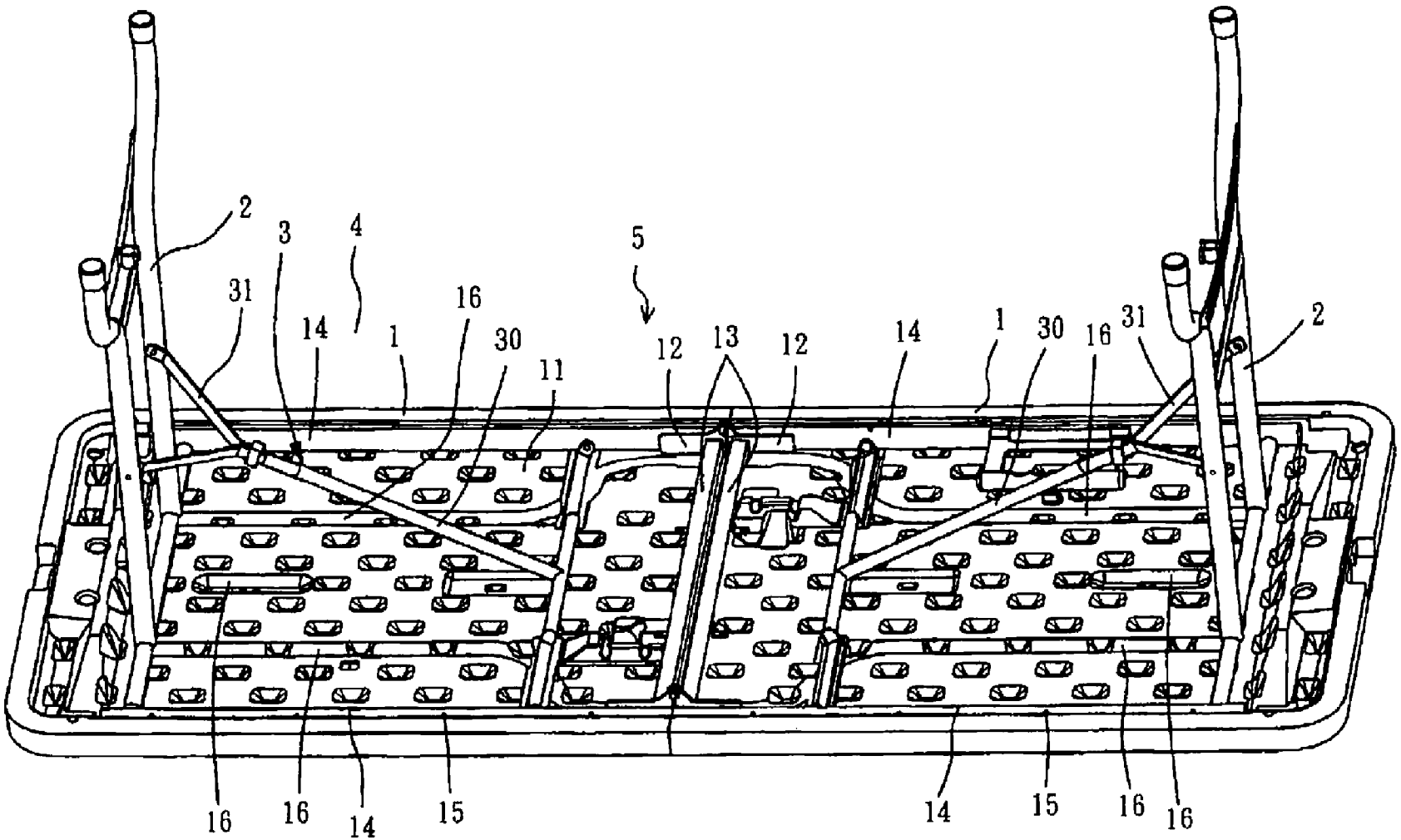
FIG. 2 is a bottom perspective view of the foldable table as shown in FIG. 1.
Figure 3:
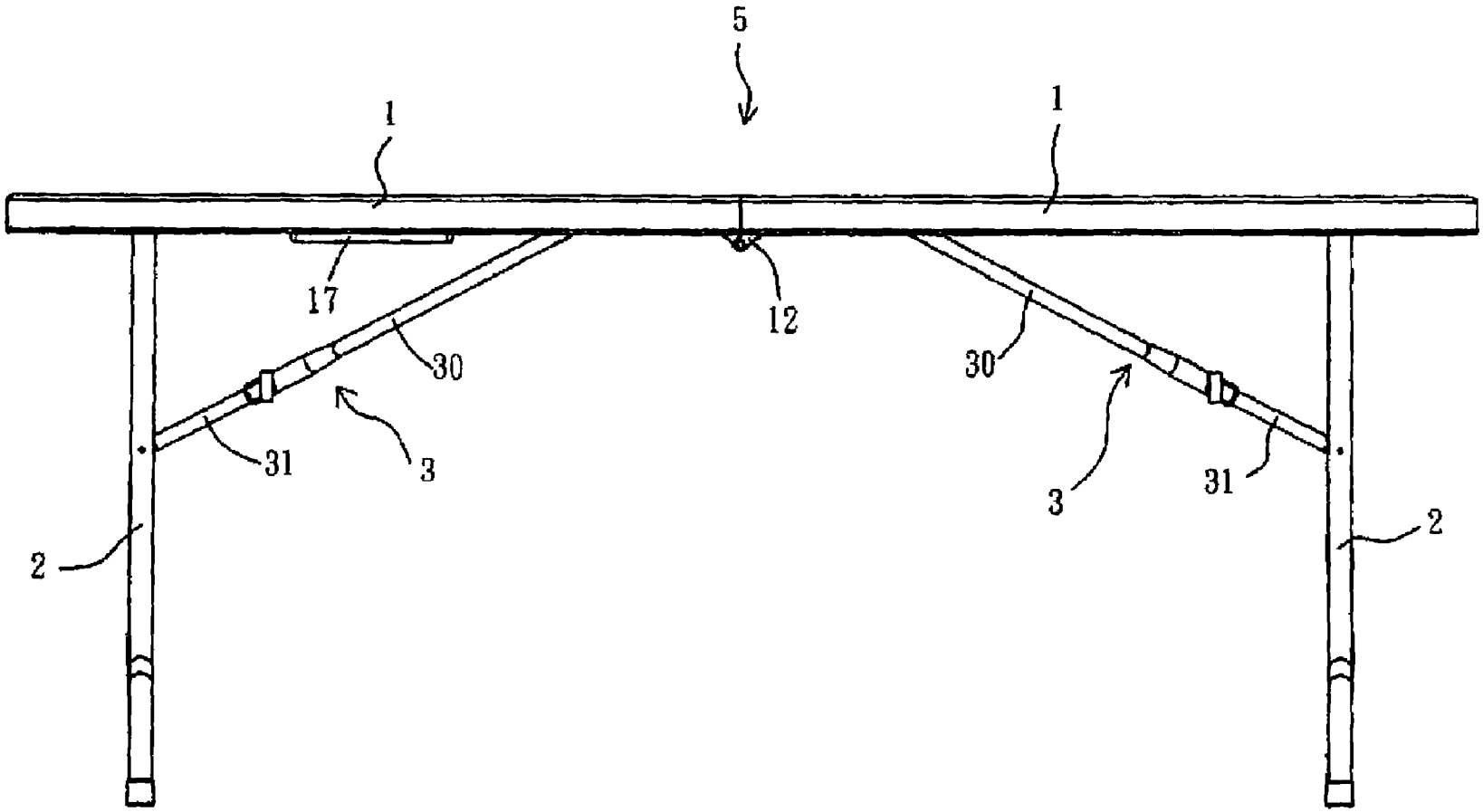
FIG. 3 is a front plan view of the foldable table as shown in FIG. 1.
Figure 4:
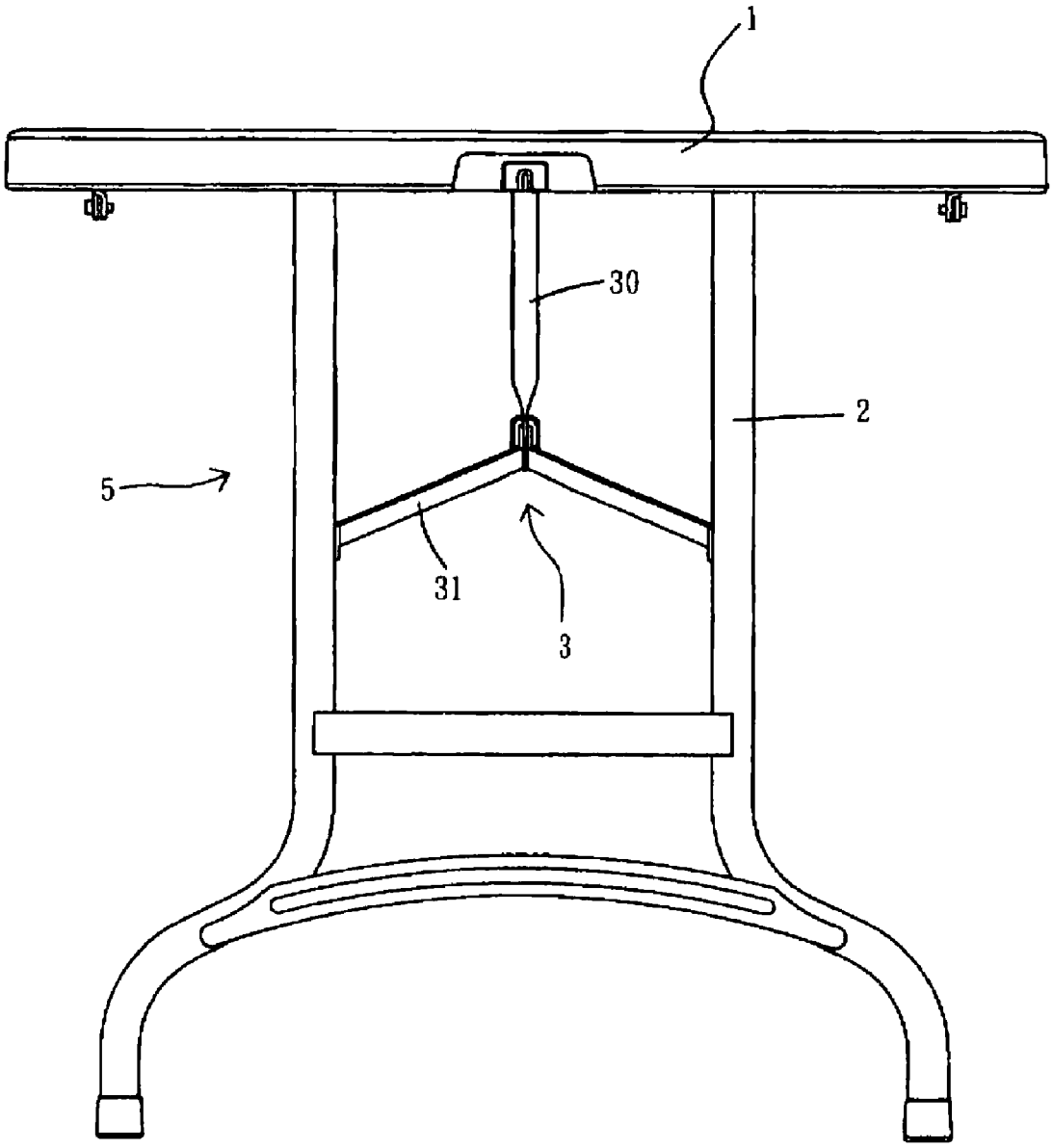
FIG. 4 is a side plan view of the foldable table as shown in FIG. 1.

Referring to the drawings and initially to FIGS. 1-8, a foldable table 5 in accordance with the preferred embodiment of the present invention comprises two table boards 1 pivotally connected with each other, and two support units 4 each foldably mounted on a respective one of the two table boards 1.

Figure 6:
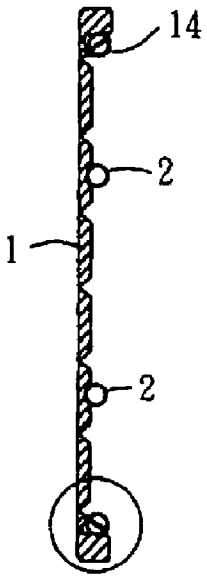
FIG. 6 is a plan cross-sectional view of the foldable table taken along line 6-6 as shown in FIG. 5.
Figure 8:
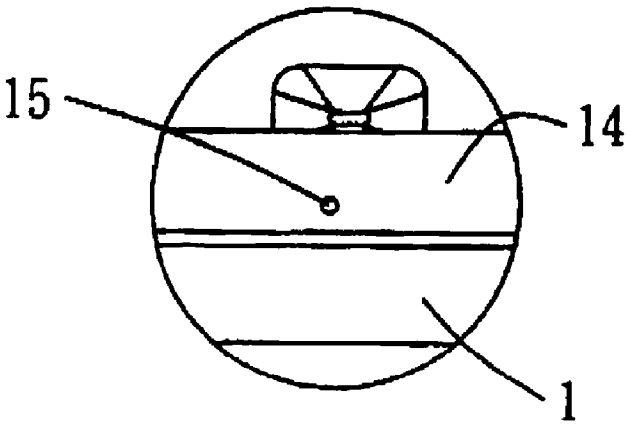
FIG. 8 is a partially enlarged view of the foldable table as shown in FIG. 5.
Figure 7:
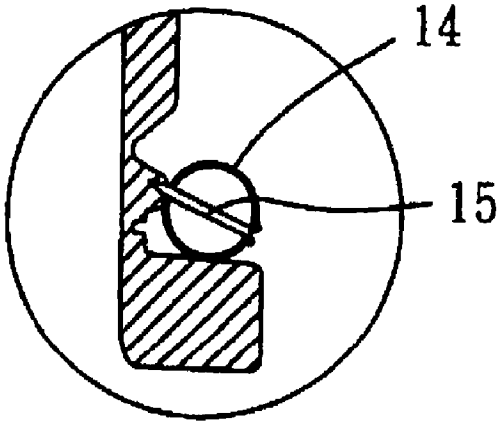
FIG. 7 is a partially enlarged view of the foldable table as shown in FIG. 6.
Figure 9:
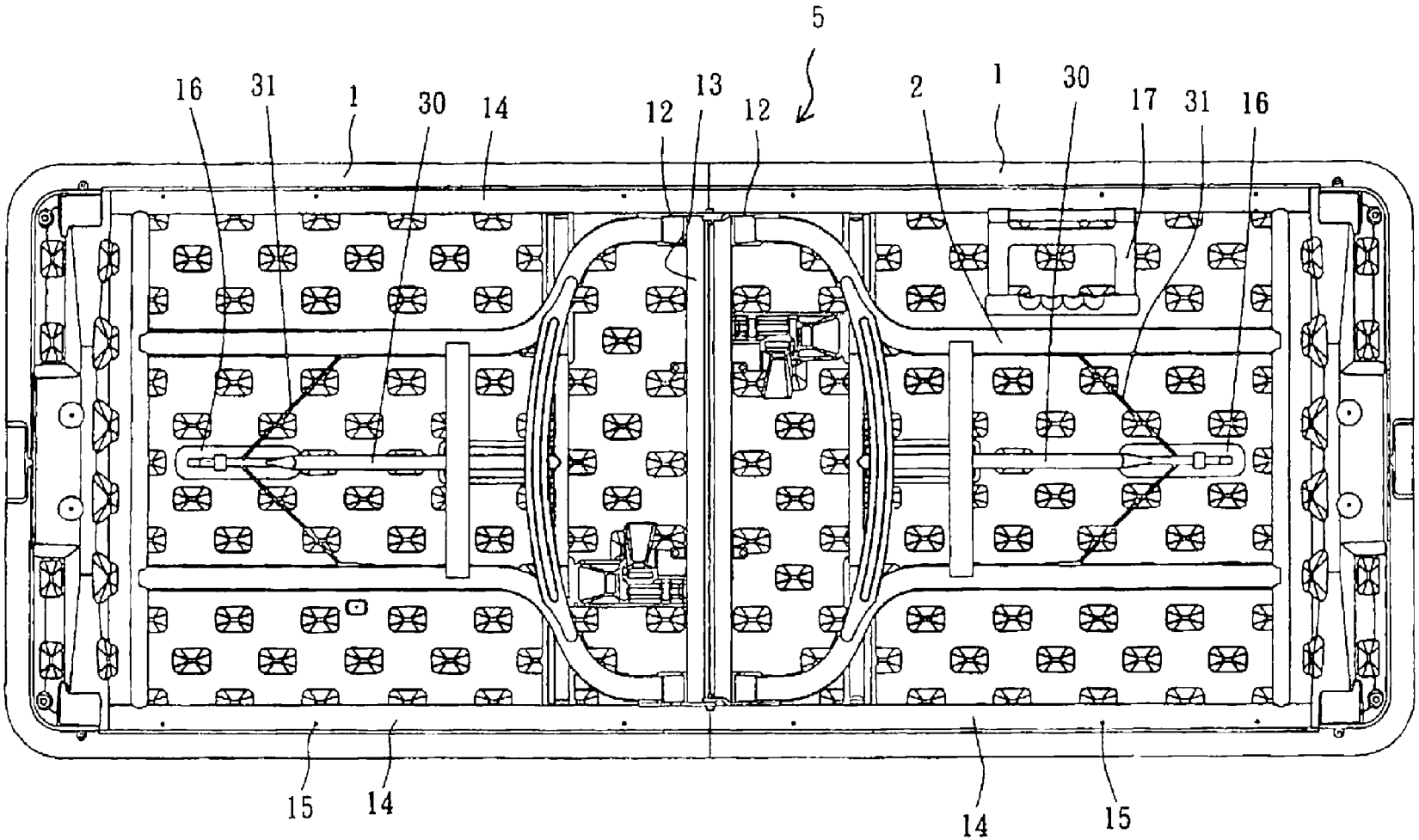
FIG. 9 is a partially enlarged view of the foldable table as shown in FIG. 5.

The two table boards 1 are pivotally connected with each other by two pivot members 12. Each of the two table boards 1 has a bottom formed with a receiving space 11. The foldable table further comprises two juxtaposed reinforcement members 13 each secured on an edge of a respective one of the two table boards 1. The receiving space 11 of each of the two table boards 1 has two sides each provided with a support tube 14 secured on each of the two table boards 1 by a plurality of screws 15 as shown in FIGS. 6-8.

Each of the support units 4 is mounted in the receiving space 11 of a respective one of the two table boards 1 and includes a support stand 2 having an end pivotally mounted on a first end of the respective table board 1, and a support member 3 pivotally mounted on a second end of the respective table board 1 and pivotally connected with the support stand 2.

The support member 3 of each of the support units 4 includes a substantially T-shaped support bar 30 having a first end pivotally mounted on the second end of the respective table board 1, and a substantially V-shaped extension bar 31 having a first end pivotally mounted on a second end of the support bar 30 and a second end pivotally mounted on a mediate portion of the support stand 2.

The receiving space 11 of each of the two table boards 1 is formed with a plurality of receiving recesses 16 for receiving the support stand 2 and the support member 3 of each of the support units 4 when being folded.

Figure 5:
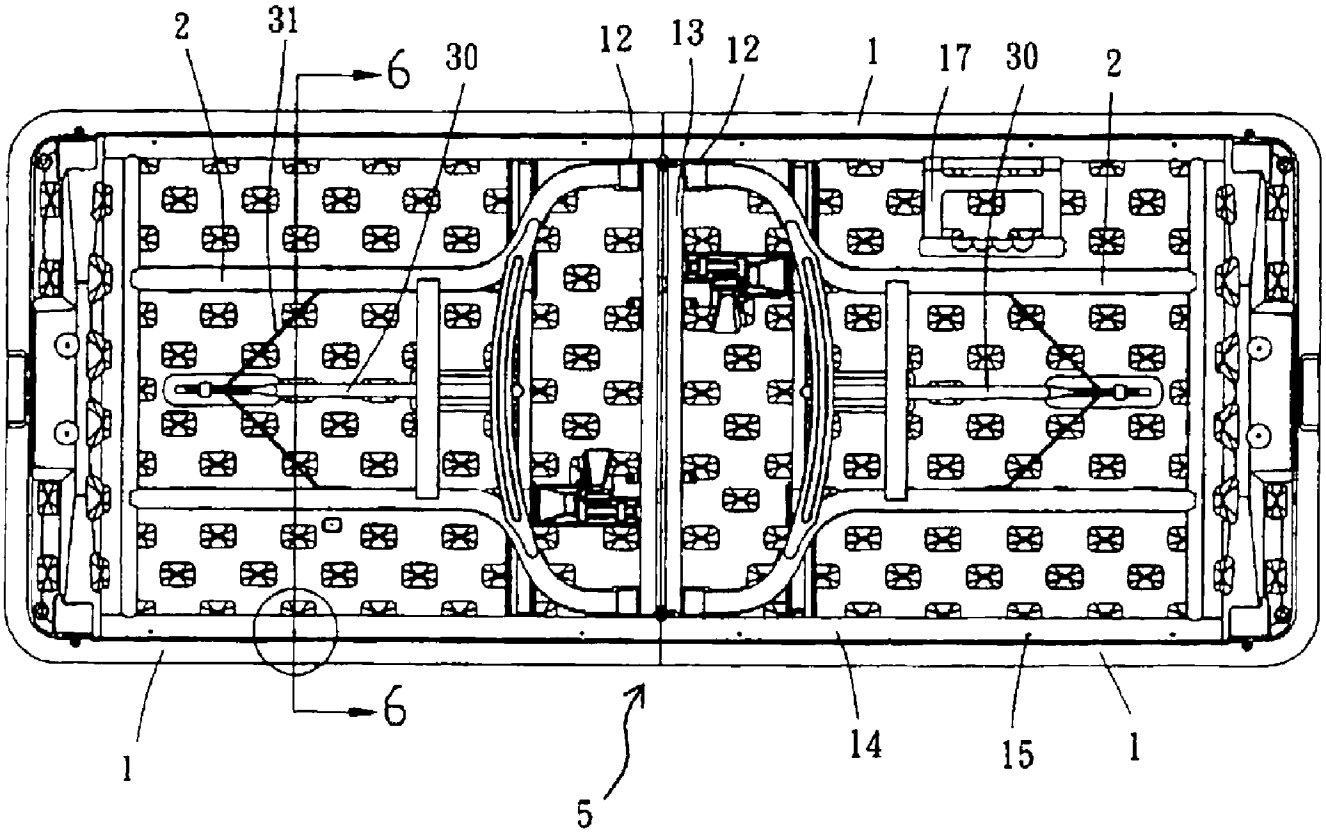
FIG. 5 is a bottom plan folded view of the foldable table as shown in FIG. 1.

As shown in FIG. 5, the foldable table 5 further comprises a handle 17 pivotally mounted on either one of the two table boards 1.

In practice, as shown in FIGS. 1-4, the support stand 2 of each of the support units 4 is pulled outward relative to the respective table board 1 to drive the support member 3 to extend outward, thereby fully stretching the support member 3, so that the two table boards 1 are supported by the support units 4 rigidly and stably, thereby fully expanding the foldable table 5 as shown in FIG. 1.

Figure 10:
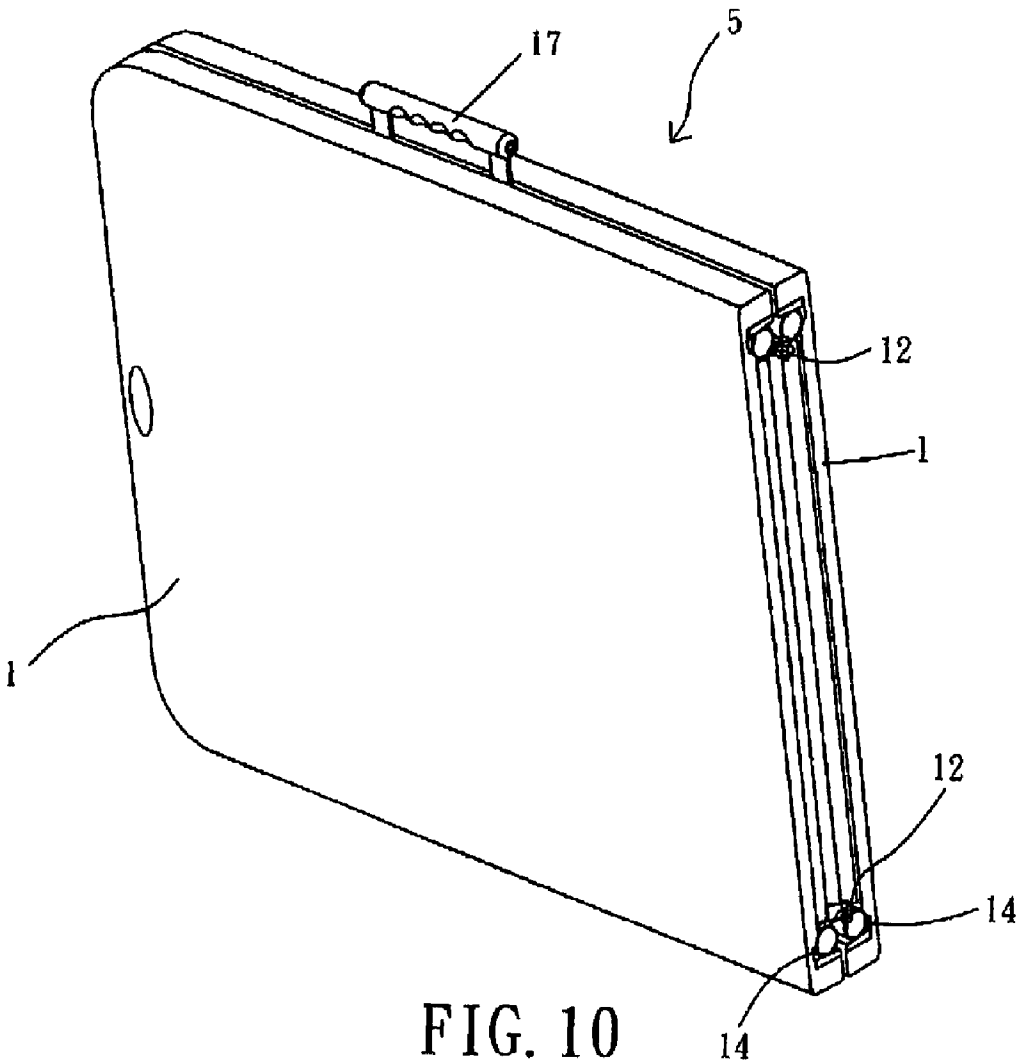
FIG. 10 is a perspective folded view of the foldable table in accordance with the preferred embodiment of the present invention.

As shown in FIGS. 5-10, when the user wishes to fold the foldable table 5, the support stand 2 of each of the support units 4 is pressed toward the respective table board 1 to drive the support member 3 to move and pivot inward, thereby folding the support member 3 and the support stand 2 into the receiving recesses 16 of the respective table board 1, so that the two table boards 1 are pivoted relative to each other, thereby folding the foldable table 5 as shown in FIG. 10. At this time, the handle 17 is pivoted outward to protrude from the two table boards 1, thereby facilitating the user carrying the foldable table 5.

Figure 11:
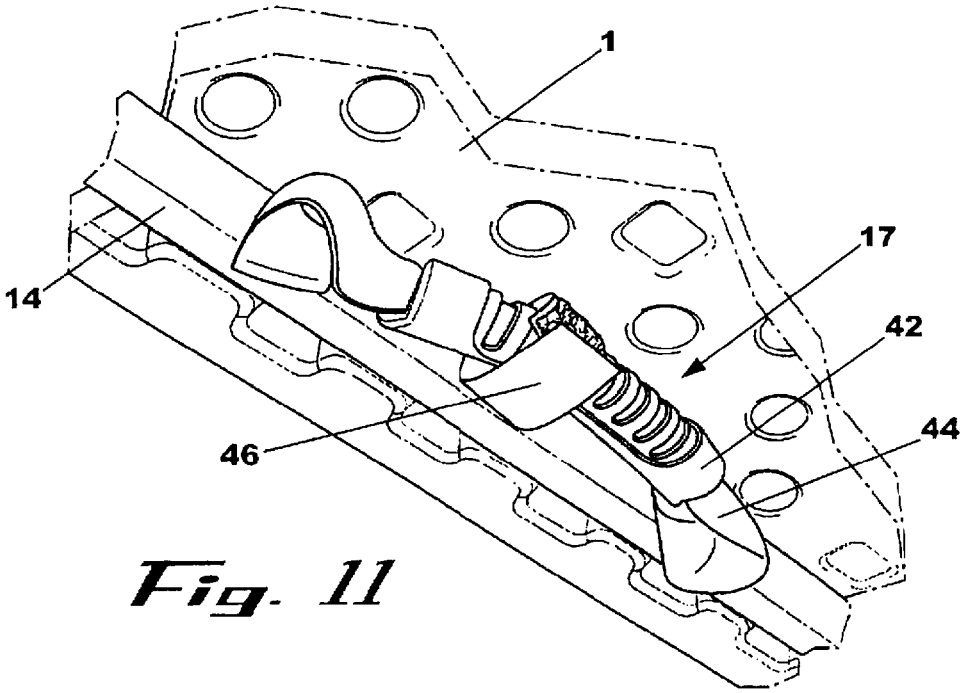
FIG. 11 depicts a handle for carrying the foldable table according to a preferred embodiment of the invention, wherein the handle is in a stowed position.
Figure 12:
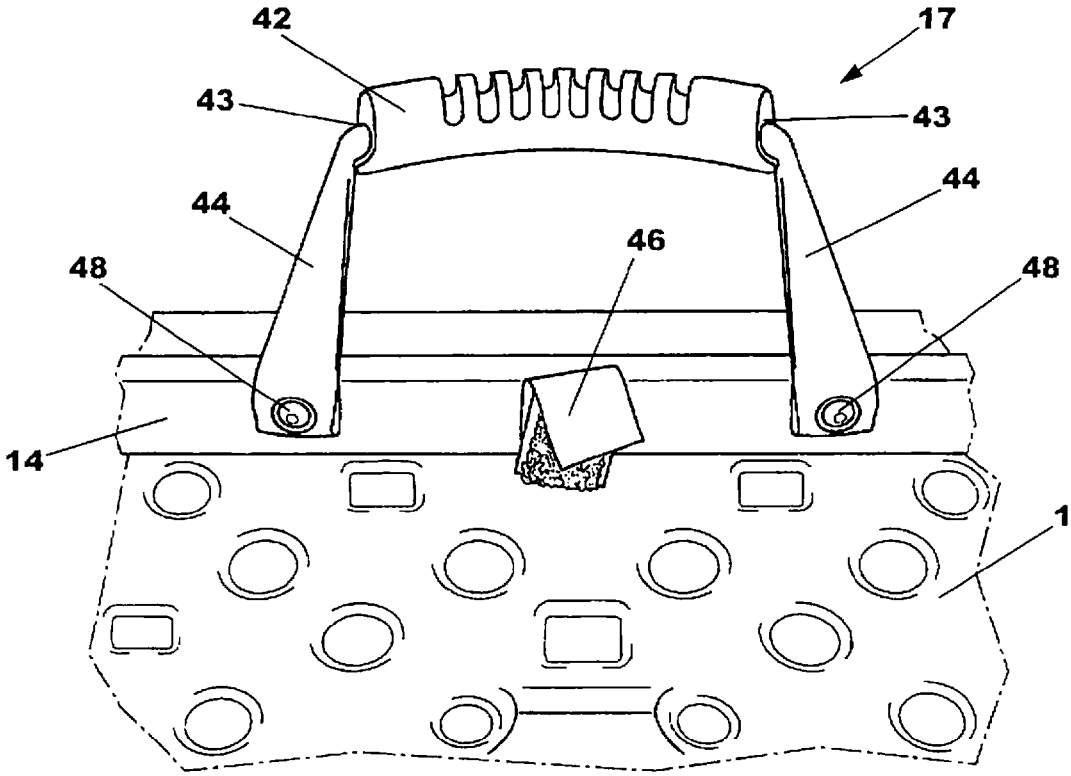
FIG. 12 depicts a handle for carrying the foldable table according to a preferred embodiment of the invention, wherein the handle is in a use position.

FIGS. 11 and 12 depict an alternative embodiment of the invention wherein the handle 17 comprises a flexible strap 44 having a central grip portion 42. The grip portion 42 preferably includes a passage 43 through which the strap 44 passes. Each end of the strap 44 is attached to the support tube 14 using fasteners 48, such as rivets or screws. The strap 44 is preferably constructed from a heavyweight woven nylon material, such as may be used in cargo straps. The grip portion 42 is preferably molded from a flexible plastic or high-density foam material.

FIG. 11 depicts the handle 17 disposed in a stowed position, wherein the grip portion 42 is releasably secured adjacent the bottom surface of the table top 1. In the stowed position, the handle 17 is generally hidden from view and does not hang down where it may contact a leg of someone sitting at the table. In the preferred embodiment, ends of the retaining strap 46 are secured around the grip portion 42 using a closure mechanism, such as a hook-and-loop closure (Velcro™) or a snap closure.

FIG. 12 depicts the handle 17 disposed in a carrying position, wherein the strap 44 is extended outward from the support tube 14. In this position, a user may easily hold the grip portion 42 for carrying the table 5 when the table 5 is in the folded position (FIG. 10).

Figure 13:
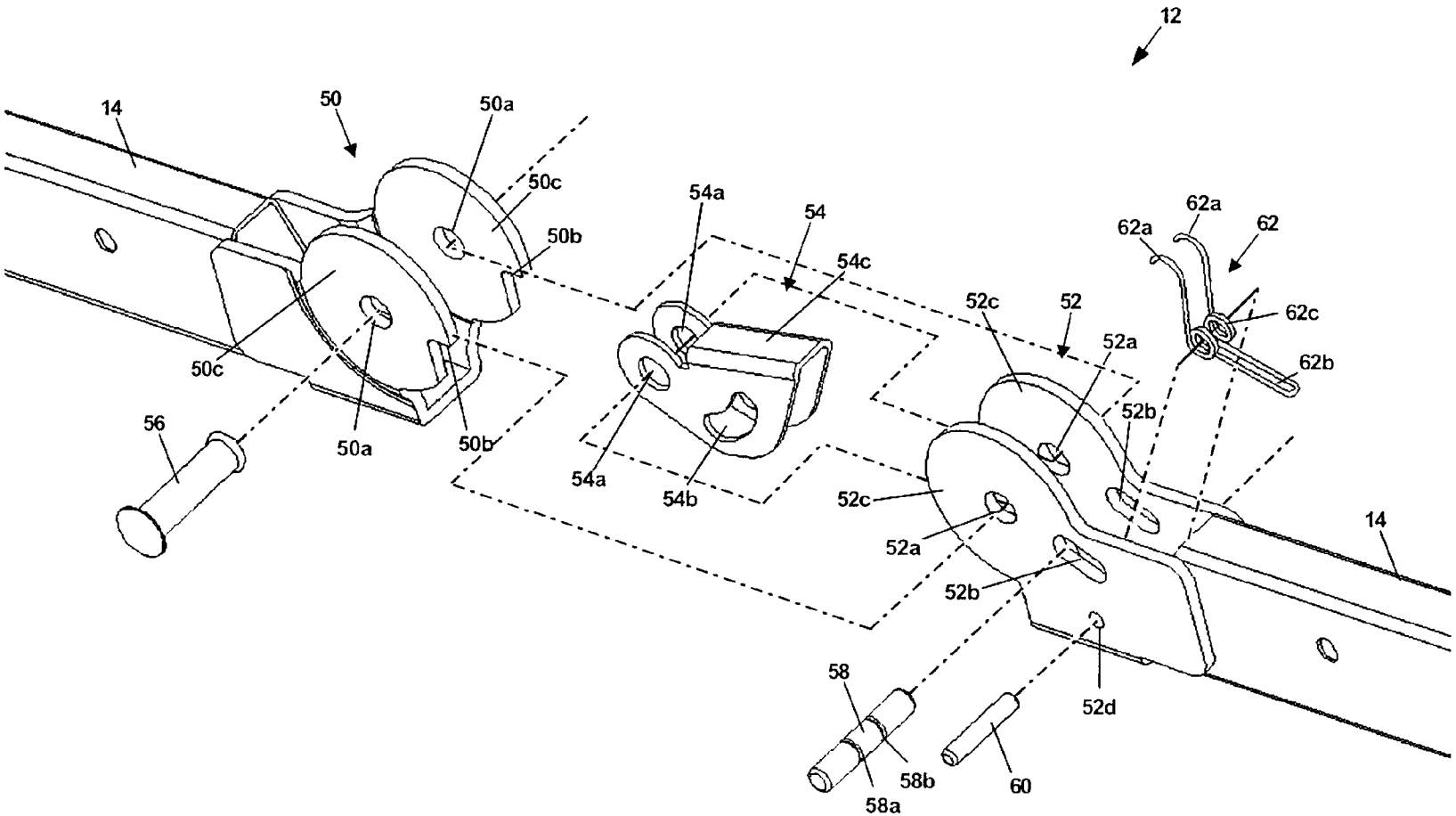
FIG. 13 depicts a hinge mechanism according to a preferred embodiment of the invention.

FIG. 13 provides an exploded view of a preferred embodiment of one of the two pivot members 12, also referred to herein as hinge assemblies 12. The hinge assembly 12 includes two hinge members 50 and 52 pivotally connected together by a hinge pin 56 which passes through apertures 50*a* and 52*a* in circular tabs 50*c* and 52*c* of the hinge members 50 and 52. Preferably, the spacing between the tabs 50*c* is sufficient to accommodate insertion of the tabs 52*c* there between.

The hinge assembly 12 includes a latch member 54 disposed between the tabs 52*c* of the hinge member 52. As shown in FIG. 13, the hinge pin 56 passes through apertures 54*a* in the latch member 54 so that the latch member is pivotally connected to the two hinge members 50 and 52. On either side of the latch member 54 are arcuate slots 54*b* through which passes a pawl pin 58. The pawl pin 58 also passes through slots 52*b* on either side of the hinge member 52. The pawl pin 58 is operable to slide laterally in the slots 52*b* between a first position (to the inner end of the slots 52*b*) and a second position (to the outer end of the slots 52*b*).

In the first position, the pawl pin 58 engages notches 50*b* in the tabs 50*c* of the hinge member 50, thereby preventing rotation of the hinge member 50 with respect to the hinge member 52. In the second position, the pawl pin 58 disengages the notches 50*b*, thereby allowing rotation of the hinge member 50 with respect to the hinge member 52.

As shown in FIG. 13, a spring 62 is connected to the hinge member 52 by way of a spring pin 60. The spring pin 60 passes through apertures 52*d* in the hinge member 52 and through a coil 62*c* formed in the spring 62. The spring 62 has spring arms 62*a* extending from the coil 62*c* that engage indentions 58*a* in the pawl pin 58. Due to tension in the coil 62*c*, the spring arms 62*a* constantly press against the pawl pin 58, thereby urging the pawl pin 58 toward the first position in the slots 52*b*.

When a user applies pressure to the surface 54*c* of the latch member 54, the latch member 54 rotates in relation to the hinge pin 56. This rotational movement of the latch member 54 urges the pawl pin 58 to slide in the slots 52*b* toward the second position. This movement of the pawl pin 58 disengages the pawl pin 58 from the notches 50*b* in the tabs 50*c* of the hinge member 50, thereby allowing the hinge members 50 and 52 to rotate in relation to each other.

Thus, when the table boards 1 are unfolded into a coplanar position, the action of the spring 62, pawl pin 58 and notches 50*b* automatically locks the table boards 1 in the coplanar position. When a user applies pressure to the surface 54*c* of the latch member, the pawl pin 58 disengages from the notches so that the table boards 1 may be folded together.

Figure 14:
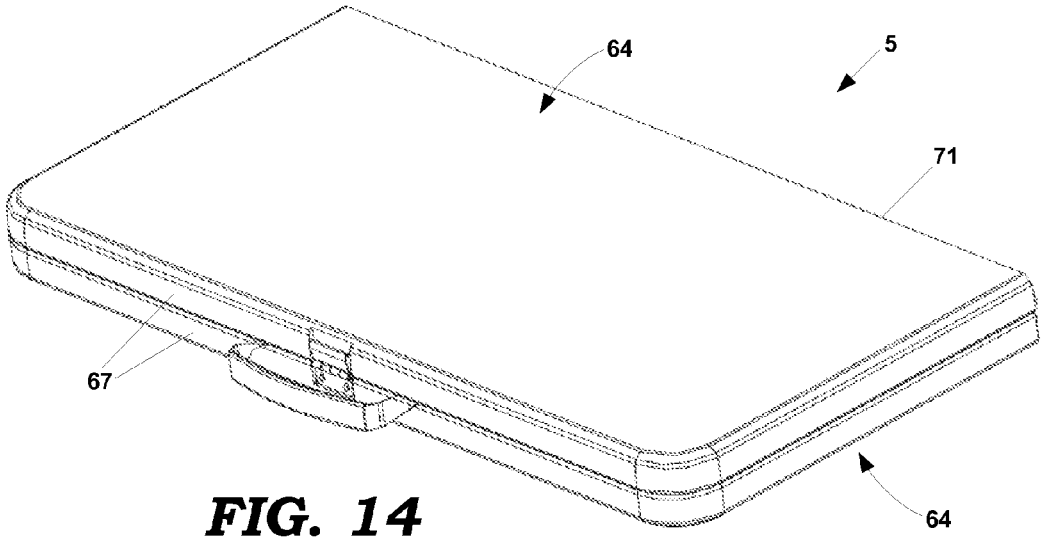
FIG. 14 is a perspective view of a substantially square foldable table in accordance with a preferred embodiment of the invention, wherein the table is in its folded position.
Figure 15:
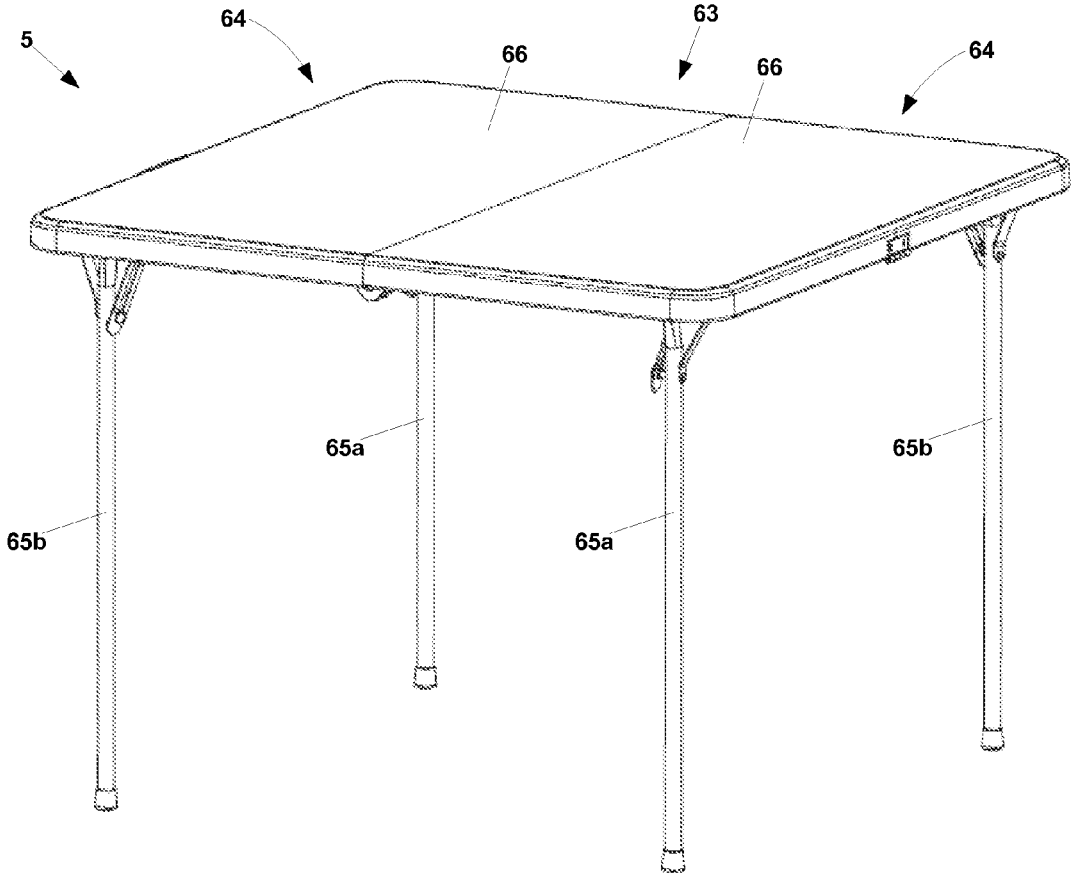
FIG. 15 is a perspective view of a substantially square foldable table in accordance with a preferred embodiment of the invention.
Figure 16:
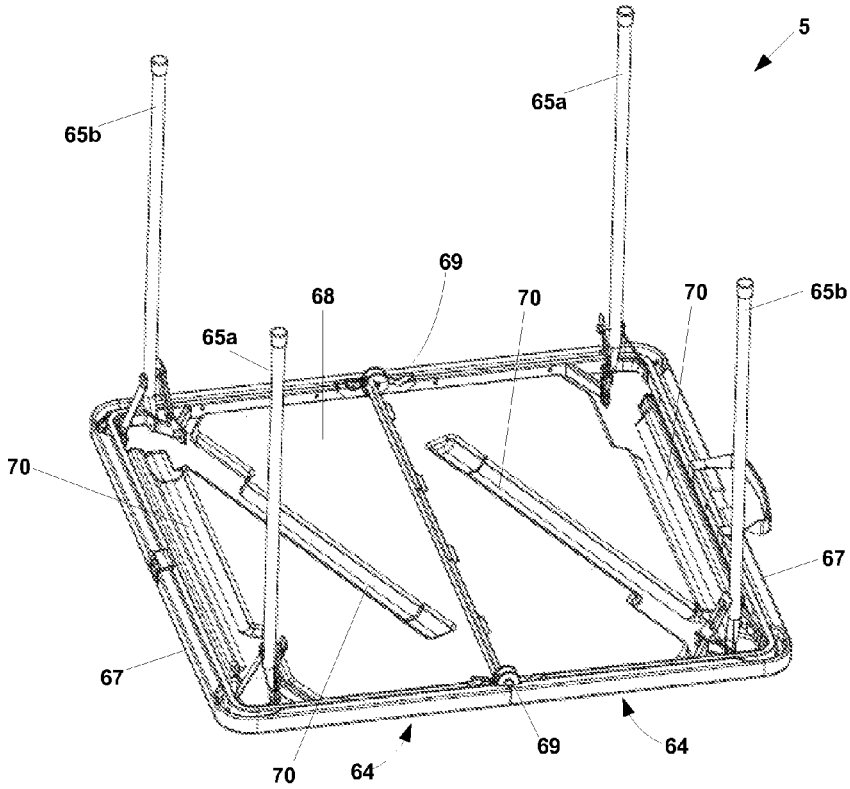
FIG. 16 is a bottom perspective view of a substantially square foldable table in accordance with a preferred embodiment of the invention, wherein the collapsible legs are extended.
Figure 17:
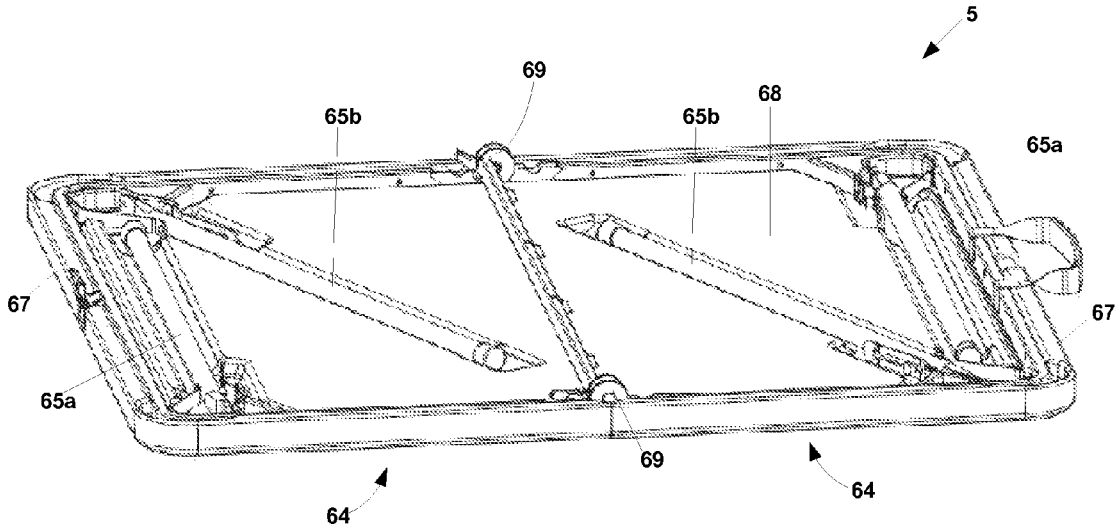
FIG. 17 is a bottom perspective view of a rectangular foldable table in accordance with an alternative embodiment of the invention, wherein the collapsible legs are in a collapsed position.
Figure 18:
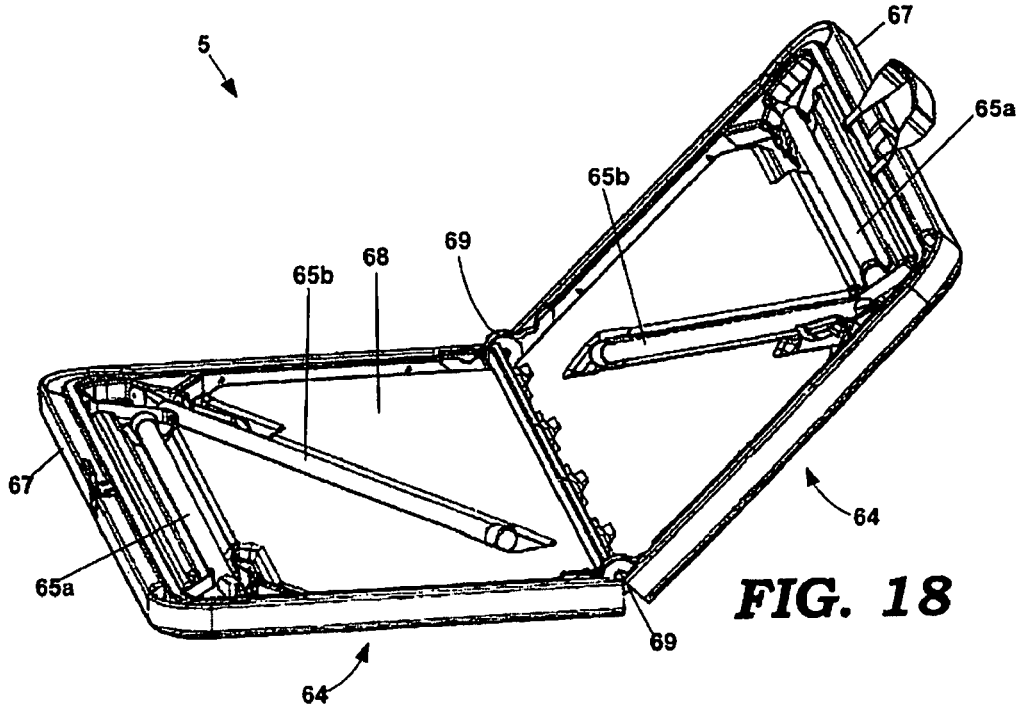
FIG. 18 is a bottom perspective view of a rectangular foldable table in accordance with an alternative embodiment of the invention, wherein the collapsible legs are in a collapsed position and the table is partially folded.
Figure 19:
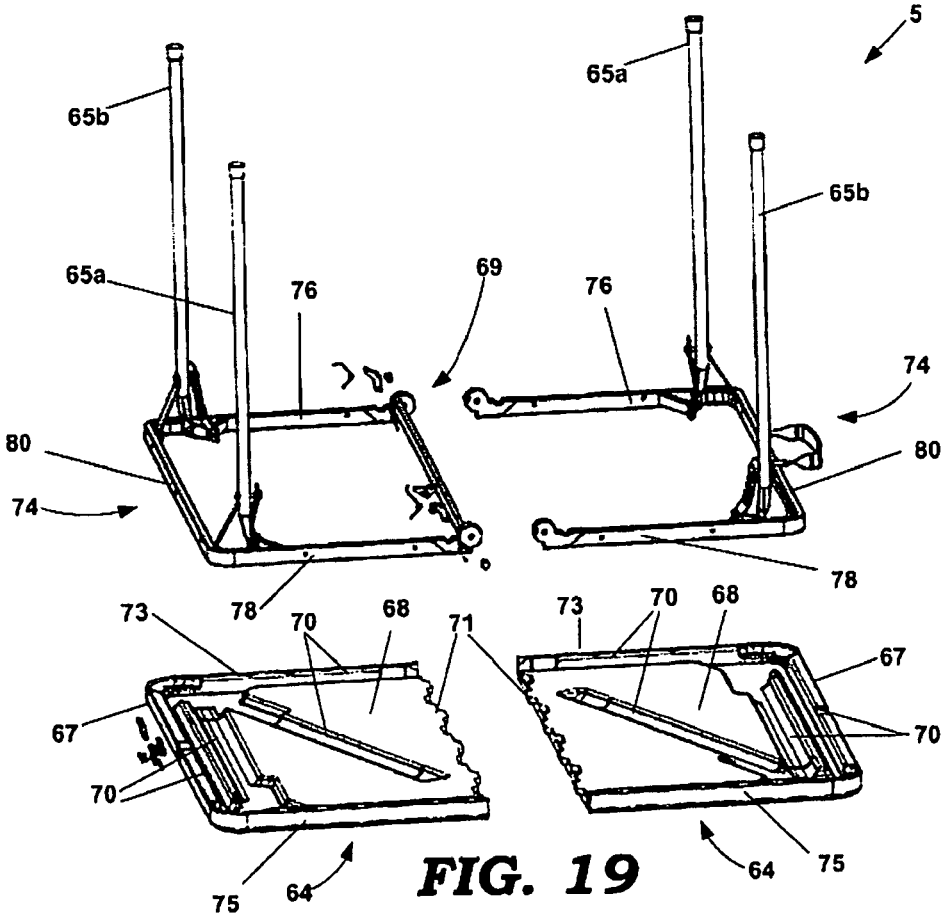
FIG. 19 depicts an exploded view of a rectangular foldable table according to an alternative embodiment of the invention.

FIGS. 14-16 depict an embodiment of the invention wherein the collapsible table 5 has a substantially square fold-in-half tabletop 63, preferably formed from blow-molded plastic. FIGS. 17-19 depict an alternative embodiment of the invention wherein the collapsible table 5 has a substantially rectangular fold-in-half tabletop 63, also preferably formed from blow-molded plastic. in each embodiment, the tabletop 63 includes two tabletop halves 64, with each half having a substantially planar top surface 66, a bottom surface 68, an inner edge 71, and an opposing outer edge 67 which is substantially parallel to the inner edge 71. As shown in FIG. 19, the two tabletop halves 64 are pivotally connected at their respective inner edges 71 by a hinge assembly 69. The particular type of hinge assembly 69 is not critical to this collapsible table as long as it provides the means for the two tabletop halves 64 to be folded together into a storage position as depicted in FIG. 14. In a preferred embodiment, the hinge assembly 69 is similar to the hinge assembly 12 discussed above and depicted in FIG. 13.

As shown in FIG. 16, collapsible legs 65*a* and 65*b* are attached by way of collapsible bracket assemblies adjacent to the outer edges 67 of the bottom surface 68 of the two tabletop halves 64. As shown in FIG. 17, the collapsible legs 65*a*-65*b* are operable to collapse to a position adjacent the bottom surface 68 of the tabletop 63. In a preferred embodiment, each of the legs 65*a*-65*b* is collapsible independently of any of the other legs 65*a*-65*b*. In a preferred embodiment, the bottom surface 68 of the tabletop 63 includes molded receiving channels 70 for receiving each of the legs 65*a*-65*b* in their respective collapsed positions.

In preferred embodiments of the invention, the collapsible legs 65*a*-65*b* comprise two pairs of legs. The first pair of legs 65*a* collapse to positions which are substantially parallel to the outer edges 67 of the tabletop 63, and the second pair of legs 65*b* collapse to positions which are substantially diagonal to the outer edges 67 of the tabletop 63. The second pair of legs 65*b* collapse at diagonal angles so that the legs 65*b* do not interfere with the ability of the tabletop 63 to fold in half along the inner edges 71 of the two tabletop halves 64. Thus, the particular angle at which the second pair of legs 65*b* collapses can vary as long as the ends of the second pair of legs 65*b* do not extend beyond the inner edges 71 of either of the tabletop halves 64. In the square tabletop embodiment of FIGS. 14-16, the diagonal collapsed position is at an angle of about 30° in relation to the outer edges 67 of the tabletop 63. In the rectangular tabletop embodiment of FIGS. 17-19, the diagonal collapsed position is at an angle of about 45° in relation to the outer edges 67 of the tabletop 63.

Referring to FIG. 19, the collapsible table 5 includes two continuous U-shaped support frames 74. Each of the first and second continuous U-shaped support frames 74 includes a first side frame portion 76, a second side frame portion 78, and an outer frame portion 80. The continuous U-shaped support frames 74 are attached to the bottom surfaces 68 of the two tabletop halves 64 such that the first side frame portions 76 are disposed adjacent the first side edges 73 of the tabletop halves 64, the second side frame portions 78 are disposed adjacent the second side edges 75 of the tabletop halves 64, and the outer frame portions 80 are disposed adjacent the outer edges 67 of the tabletop halves 64. Preferably, the collapsible legs 65*a*-65*b* are attached to the continuous U-shaped support frames 74. In a preferred embodiment, the bottom surface 68 of the tabletop halves 64 includes molded receiving channels 70 for receiving the continuous U-shaped support frames 74 and each of the legs 65*a*-65*b* in their respective collapsed positions.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A collapsible table comprising:

a tabletop comprising a first tabletop half and a second tabletop half, the first and second tabletop halves each having a substantially planar top surface, a bottom surface opposite the top surface, an inner edge, an opposing outer edge which is substantially parallel to the inner edge, a first side edge, and an opposing second side edge which is substantially parallel to the first side edge, the bottom surface of the first tabletop half having at least one receiving channel therein;

a hinge assembly for pivotally connecting the first and second tabletop halves at the inner edges, thereby allowing the first and second tabletop halves to be folded together into a storage position; and collapsible legs attached to the bottom surfaces of the tabletop halves, including:

at least a first collapsible leg attached to the first tabletop half which is operable to collapse at least partially into the at least one receiving channel in the bottom surface of the first tabletop half to a fully collapsed position in which the first collapsible leg is parallel to the bottom surface of the first tabletop half and diagonal to the outer edge of the first tabletop half; and at least a second collapsible leg attached to the first tabletop half which is operable to collapse at least partially into the at least one receiving channel in the bottom surface of the first tabletop half to a fully collapsed position in which the second collapsible leg is parallel to the bottom surface of the first tabletop half and parallel to the outer edge of the first tabletop half.

2. The collapsible table of claim 1 wherein each of the collapsible legs is operable to collapse independently of any of the other legs.

3. The collapsible table of claim 1 wherein the tabletop is substantially square.

4. The collapsible table of claim 1 wherein the first and second tabletop halves are each formed from blow molded plastic.

5. The collapsible table of claim 1 wherein the hinge assembly is a latching hinge assembly including a latch member for locking the tabletop halves into an unfolded position and for unlocking the tabletop halves from the unfolded position to allow the first and second tabletop halves to be folded together into a storage position.

6. The collapsible table of claim 1 wherein the bottom surface of the second tabletop half has at least one receiving channel therein, and the collapsible legs further comprise:

at least a third collapsible leg attached to the second tabletop half which is operable to collapse at least partially into the at least one receiving channel in the bottom surface of the second tabletop half to a fully collapsed position in which the third collapsible leg is substantially parallel to the bottom surface of the second tabletop half and substantially diagonal to the outer edge of the second tabletop half; and at least a fourth collapsible leg attached to the second tabletop half which is operable to collapse at least partially into the at least one receiving channel in the bottom surface of the second tabletop half to a fully collapsed position in which the fourth collapsible leg is substantially parallel to the bottom surface of the second tabletop half and substantially parallel to the outer edge of the second tabletop half.

7. The collapsible table of claim 1 where in the fully collapsed position the first collapsible leg is at substantially a 30 degree angle to the outer edge of the first tabletop half.

8. The collapsible table of claim 1 where in the fully collapsed position the first collapsible leg is at substantially a 45 degree angle to the outer edge of the first tabletop half.

9. The collapsible table of claim 1 wherein the bottom surface of the first tabletop half includes a plurality of receiving channels therein, and the first collapsible leg is operable to collapse at least partially into one of the plurality of receiving channels and the second collapsible leg is operable to collapse at least partially into another of the plurality of receiving channels.

10. A collapsible table comprising:

a tabletop comprising a first tabletop half and a second tabletop half, the first and second tabletop halves each having a substantially planar top surface, a bottom surface opposite the top surface and having a plurality of receiving channels therein, an inner edge, an opposing outer edge which is substantially parallel to the inner edge, a first side edge, and an opposing second side edge which is substantially parallel to the first side edge;

a first continuous U-shaped support frame attached to the bottom surface of the first tabletop half and disposed at least partially within the plurality of receiving channels of the first tabletop half, the first U-shaped support frame having a first side frame portion disposed adjacent the first side edge of the first tabletop half, an outer frame portion disposed adjacent the outer edge of the first tabletop half, and a second side frame portion disposed adjacent the second side edge of the first tabletop half;

a second continuous U-shaped support frame attached to the bottom surface of the second tabletop half and disposed at least partially within the plurality of receiving channels of the second tabletop half, the second U-shaped support frame having a first side frame portion disposed adjacent the first side edge of the second tabletop half, an outer frame portion disposed adjacent the outer edge of the second tabletop half, and a second side frame portion disposed adjacent the second side edge of the second tabletop half;

a hinge assembly disposed adjacent the inner edges of the first and second tabletop halves, the hinge assembly for pivotally connecting the first side frame portion of the first continuous U-shaped support frame to the first side frame portion of the second continuous U-shaped support frame and for pivotally connecting the second side frame portion of the first continuous U-shaped support frame to the second side frame portion of the second continuous U-shaped support frame; and at least four collapsible legs attached to the first and second U-shaped support frames, wherein each leg is operable to collapse independently of any of the other legs at least partially into the plurality of receiving channels of the bottom surface of the tabletop half to which the U-shaped support frame is attached, wherein the collapsible legs comprise:

a first pair of legs that collapse to fully collapsed positions in which the first pair of legs are parallel to the outer frame portions of the continuous U-shaped support frames and parallel to the bottom surfaces of to first and second tabletop halves; and a second pair of legs that collapse to fully collapsed positions in which the second pair of legs are diagonal to the outer frame portions of the continuous U-shaped support frames and parallel to bottom surfaces of the first and second tabletop halves.

11. The collapsible table of claim 10 where in the fully collapsed position the second pair of legs are at substantially 30 degree angles from the outer frame portions of the continuous U-shaped support frames.

12. The collapsible table of claim 10 where in the frilly collapsed position the second pair of legs are at substantially 45 degree angles from the outer frame portions of the continuous U-shaped support frames.

13. A collapsible table comprising:

a substantially square tabletop comprising a first tabletop half and a second tabletop half, the first and second tabletop halves each formed from blow-molded plastic and having a substantially planar top surface, a bottom surface opposite the top surface and having a plurality of receiving channels therein, an inner edge, an opposing outer edge which is substantially parallel to the inner edge, a first side edge, and an opposing second side edge which is substantially parallel to the first side edge;

a first continuous U-shaped support frame attached to the bottom surface of the first tabletop half and disposed at least partially within the plurality of receiving channels of the first tabletop half, the first U-shaped support frame having a first side frame portion disposed adjacent the first side edge of the first tabletop half, an outer frame portion disposed adjacent the outer edge of the first tabletop half, and a second side frame portion disposed adjacent the second side edge of the first tabletop half;

a second continuous U-shaped support frame attached to the bottom surface of the second tabletop half and disposed at least partially within the plurality of receiving channels of the second tabletop half, the second U-shaped support frame having a first side frame portion disposed adjacent the first side edge of the second tabletop half, an outer frame portion disposed adjacent the outer edge of the second tabletop half, and a second side frame portion disposed adjacent the second side edge of the second tabletop half;

a latching hinge assembly disposed adjacent the inner edges of the first and second tabletop halves, the hinge assembly for pivotally connecting the first side frame portion of the first continuous U-shaped support frame to the first side frame portion of the second continuous U-shaped support frame and for pivotally connecting the second side frame portion of the first continuous U-shaped support frame to the second side frame portion of the second continuous U-shaped support frame, the latching hinge assembly including a latch member for locking the tabletop halves into an unfolded position and for unlocking the tabletop halves from the unfolded position to allow the first and second tabletop halves to be folded together into a storage position; and at least for collapsible legs attached to the first and second U-shaped support frames, wherein each leg is operable to collapse independently of any of the other legs at least partially into the plurality of receiving channels of the bottom surface of the tabletop half to which the U-shaped support frame is attached, the collapsible legs comprising:

a first pair of legs operable to collapse to fully collapsed positions in which the first pair of legs are parallel to the outer frame portions of the continuous U-shaped support frames and parallel to the bottom surfaces of the first and second tabletop halves; and a second pair of legs operable to collapse to fully collapsed positions in which the second pair of legs are diagonal to the outer frame portions of the continuous U-shaped support frames and parallel to the bottom surfaces of the first and second tabletop halves.

14. The collapsible table of claim 13 where in the frilly collapsed position the second pair of legs are at substantially 30 degree angles from the outer frame portions of the continuous U-shaped support frames.

15. A collapsible table comprising:

a tabletop comprising a first tabletop half and a second tabletop half, the first and second tabletop halves each having a substantially planar top surface, a bottom surface opposite the top surface, an inner edge, an opposing outer edge which is substantially parallel to the inner edge, a first side edge, and an opposing second side edge which is substantially parallel to the first side edge, the bottom surfaces of the first and second tabletop halves each having at least one receiving channel therein;

a hinge assembly for pivotally connecting the first and second tabletop halves at the inner edges, thereby allowing the first and second tabletop halves to be folded together into a storage position; and four collapsible legs attached to the tabletop, the four collapsible legs consisting of:

a first collapsible leg attached to the first tabletop half which is operable to collapse at least partially into the at least one receiving channel in the bottom surface of the first tabletop half to a frilly collapsed position in which the first collapsible leg is substantially parallel to the bottom surface of the first tabletop half and substantially diagonal to the outer edge of the first tabletop half;

a second collapsible leg attached to the first tabletop half which is operable to collapse at least partially into the at least one receiving channel in the bottom surface of the first tabletop half to a fully collapsed position in which the second collapsible leg is parallel to the bottom surface of the first tabletop half and parallel to the outer edge of the first tabletop half;

a third collapsible leg attached to the second tabletop half which is operable to collapse at least partially into the at least one receiving channel in the bottom surface of the second tabletop half to a fully collapsed position in which the third collapsible leg is parallel to the bottom surface of the second tabletop half and diagonal to the outer edge of the second tabletop half; and a fourth collapsible leg attached to the second tabletop half which is operable to collapse at least partially into the at least one receiving channel in the bottom surface of the second tabletop half to a fully collapsed position in which the fourth collapsible leg is parallel to the bottom surface of the second tabletop half and parallel to the outer edge of the second tabletop half.

* * * * *